US009328972B2

(12) United States Patent
Kent

(10) Patent No.: US 9,328,972 B2
(45) Date of Patent: May 3, 2016

(54) CONDENSER HAVING A RECEIVER/DEHYDRATOR TOP ENTRANCE WITH COMMUNICATION CAPABLE OF STABILIZED CHARGE PLATEAU

(75) Inventor: Scott E. Kent, Albion, NY (US)

(73) Assignee: MAHLE International GmbH, Stuttgart (DE)

( * ) Notice: Subject to any disclaimer, the term of this patent is extended or adjusted under 35 U.S.C. 154(b) by 787 days.

(21) Appl. No.: 13/586,152

(22) Filed: Aug. 15, 2012

(65) Prior Publication Data

US 2013/0206378 A1 Aug. 15, 2013

Related U.S. Application Data

(60) Provisional application No. 61/524,148, filed on Aug. 16, 2011.

(51) Int. Cl.

| | |
|---|---|
| ***F25B 39/04*** | (2006.01) |
| ***F28F 9/02*** | (2006.01) |
| *F25B 40/02* | (2006.01) |

(52) U.S. Cl.

CPC . *F28F 9/02* (2013.01); *F25B 39/04* (2013.01); *F25B 40/02* (2013.01); *F25B 2339/0441* (2013.01)

(58) Field of Classification Search

CPC ... F28F 9/02; F25B 2339/044; F28D 1/05391
USPC ..... 165/173, 174; 62/507
See application file for complete search history.

(56) References Cited

U.S. PATENT DOCUMENTS

| | | | | |
|---|---|---|---|---|
| 5,159,821 | A * | 11/1992 | Nakamura | 62/509 |
| 5,546,761 | A * | 8/1996 | Matsuo et al. | 62/509 |
| 5,713,217 | A * | 2/1998 | Baba | 62/509 |
| 5,813,249 | A * | 9/1998 | Matsuo et al. | 62/509 |

(Continued)

FOREIGN PATENT DOCUMENTS

| | | | |
|---|---|---|---|
| DE | 197 53 641 | A1 | 6/1998 |
| DE | 199 26 990 | A1 | 12/1999 |

(Continued)

OTHER PUBLICATIONS

International Search Report.

(Continued)

*Primary Examiner* — Allen Flanigan
*Assistant Examiner* — Filip Zec
(74) *Attorney, Agent, or Firm* — Brinks Gilson & Lione

(57) ABSTRACT

A sub-cooled condenser for an air conditioning system includes a condenser portion, a sub-cooler portion located below that of the condenser portion, an integral receiver tank having an upper receiver first chamber with a first fluid port in hydraulic connection with the condenser portion and a lower receiver second chamber having a second fluid port in hydraulic connection with the sub-cooler portion, and a refrigerant conduit disposed in the receiver tank. The refrigerant conduit may include a top entry end extending into the upper receiver first chamber and a bottom discharge end extending in the lower receiver second chamber, wherein the bottom discharge end may extend below the second fluid port. The condenser portion may include multiple passes in which the refrigerant flows in an upward direction from the inlet of the condenser portion to the first fluid port that is in hydraulic connection to the upper receiver first chamber.

9 Claims, 5 Drawing Sheets

(56) References Cited

U.S. PATENT DOCUMENTS

| | | | | |
|---|---|---|---|---|
| 6,267,173 | B1 | 7/2001 | Hu et al. | |
| 6,374,632 | B1 * | 4/2002 | Nobuta et al. | 62/509 |
| 6,397,627 | B1 * | 6/2002 | Aki et al. | 62/509 |
| 6,430,945 | B1 * | 8/2002 | Haussmann | 62/117 |
| 6,494,059 | B2 | 12/2002 | Yamazaki et al. | |
| 6,698,235 | B2 * | 3/2004 | Nobuta et al. | 62/509 |
| 7,213,412 | B2 | 5/2007 | Kent et al. | |

FOREIGN PATENT DOCUMENTS

| | | | |
|---|---|---|---|
| DE | 103 50 192 | A1 | 5/2004 |
| FR | 2 777 638 | A1 | 10/1999 |

OTHER PUBLICATIONS

Development of Sub-Cool System; Y. Yamanska, H. Matsuo, Kaoru Tuzuki, Toshio Tsuboko; pp. 37-42.

* cited by examiner

CONDENSER HAVING A RECEIVER/DEHYDRATOR TOP ENTRANCE WITH COMMUNICATION CAPABLE OF STABILIZED CHARGE PLATEAU

CROSS-REFERENCE TO RELATED APPLICATION

This application claims the benefit of U.S. Provisional Patent Application Ser. No. 61/524,148 for a CONDENSER HAVING A RECEIVER/DEHYDRATOR TOP ENTRANCE WITH COMMUNICATION CAPABLE OF STABILIZED CHARGE PLATEAU, filed on Aug. 16, 2011, which is hereby incorporated by reference in its entirety.

TECHNICAL FIELD OF INVENTION

The present disclosure relates to an air conditioning system; specifically, to a condenser for an air-conditioning system; and more specifically, to a sub-cooled condenser having a receiver/dehydrator tank.

BACKGROUND OF INVENTION

Heat exchangers used to condense a high pressure vapor refrigerant into a high pressure liquid refrigerant for an air-conditioning system are known in the art and are referred to as condensers. Condensers having an integral sub-cooler portion, also known as sub-cooled condensers, typically include a plurality of refrigerant tubes in hydraulic communication with two spaced apart headers, such as an inlet/outlet header and a return header. The tubes are divided into an upstream group and a downstream group, or "sub-cooling" group. For condensers having an inlet/outlet header and a return header, the headers typically include an internal partition that divides each of the headers into a first chamber and a second chamber. The first chambers are in hydraulic communication with the upstream group of tubes to define a condenser portion and the second chambers are in hydraulic communication with the sub-cooling group of tubes to define a sub-cooler portion.

A high pressure vapor refrigerant enters the first chamber of the inlet/outlet header and flows through the upstream group of tubes into the first chamber of the return header. As the refrigerant flows through this condenser portion, the refrigerant is condensed, or liquefied, into a high pressure liquid refrigerant at or near its saturation temperature. The liquefied refrigerant is then directed through a refrigerant reservoir assembly, also known as a receiver/dehydrator tank, having a desiccant material to remove any water before entering the second chamber of the return header to be directed through the sub-cooling group of tubes. As the refrigerant flows through this sub-cooler portion, the high temperature liquid refrigerant is sub-cooled below its saturation temperature. It is known that sub-cooled refrigerant improves the overall cooling performance of an air-conditioning system.

There exists a need to provide a stable liquefied refrigerant to the sub-cooler portion of the condenser for improved sub-cooling of the refrigerant. There also exists a need to maintain a sufficient amount of refrigerant reserve in the receiver tank to account for refrigerant leakage over the operating life of the air-conditioning system while minimizing the amount of refrigerant charge in the air-conditioning system without compromising the efficiency of the air-conditioning system. There is also a further need to minimize the size and complexity of the sub-cooled condenser for ease of plumbing and assembly into a motor vehicle.

SUMMARY OF THE INVENTION

In accordance with an embodiment of the present invention is a sub-cooled condenser for use in an air conditioning system, in which the sub-cooled condenser includes an upstream group of refrigerant tubes and a downstream group of refrigerant tubes extending between a first and second header to define a condenser portion and a sub-cooler portion, respectively. The condenser portion is located above the sub-cooler portion with respect to the direction of gravity. The sub-cooled condenser also includes an elongated receiver housing extending adjacently parallel to the second header, wherein the receiver housing includes a first fluid port in hydraulic connection with the condenser portion for receiving a refrigerant from the condenser portion and a second fluid port in hydraulic connection with the sub-cooler portion for discharging a refrigerant to the sub-cooler portion, and a refrigerant conduit disposed in the receiver housing. The refrigerant conduit includes a top entry end and a bottom discharge end spaced from the top entry end, wherein the top entry end is in hydraulic communication with the first fluid port and the bottom discharge end is in hydraulic communication with the second fluid port. The bottom discharge end may be below that of the second fluid port.

The receiver housing may include a receiver separator dividing the receiver housing into a receiver first chamber and a receiver second chamber, wherein the top entry end of refrigerant conduit extends into the receiver first chamber and the bottom discharge end of refrigerant conduit extends in the receiver second chamber.

Each of the first chamber of the first header and the first chamber of the second header may include at least one chamber partition to divide the condenser portion into multiple passes including a first-pass and a last-pass, wherein the first pass is below that of the last-pass. The first chamber of the first header may include an inlet opening adjacent to and in hydraulic communication with the first-pass. The second chamber of the first header may include an outlet opening adjacent to and in hydraulic communication with the sub-cooler portion.

The receiver second chamber of the receiver housing is sized to contain a sufficient refrigerant capacity to absorb fluctuations in the required amount of refrigeration caused through changes in operating conditions inside the refrigeration cycle and to safe-guard against the amount of refrigerant loss due to leakage from hoses and fittings over the life of the air-conditioning system, while maintaining a surface level of liquid refrigerant above that of the second fluid port.

In an alternative embodiment, the refrigerant conduit entry end may be coupled to the first fluid port such that the refrigerant conduit is in direct hydraulic communication with the condenser portion, thereby eliminating the need to divide the receiver housing into a receiver first chamber and a receiver second chamber.

An advantage of an embodiment of the sub-cooled condenser having a top entrance receiver tank ensures a stable liquefied refrigerant to the sub-cooler portion of the sub-cooled condenser. Another advantage is that the sub-cooled condenser absorbs the fluctuations in the required refrigerant amount inside the refrigerant cycle caused through changes in load demands. Yet another advantage is that the sub-cooled condenser maintains constant performance and quality against leakage of refrigerant from hoses and fittings. Still yet another advantage is that the sub-cooled condenser is compact and simple to plumb within a motor vehicle.

Further features and advantages of the invention will appear more clearly on a reading of the following detailed description of an embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 4:
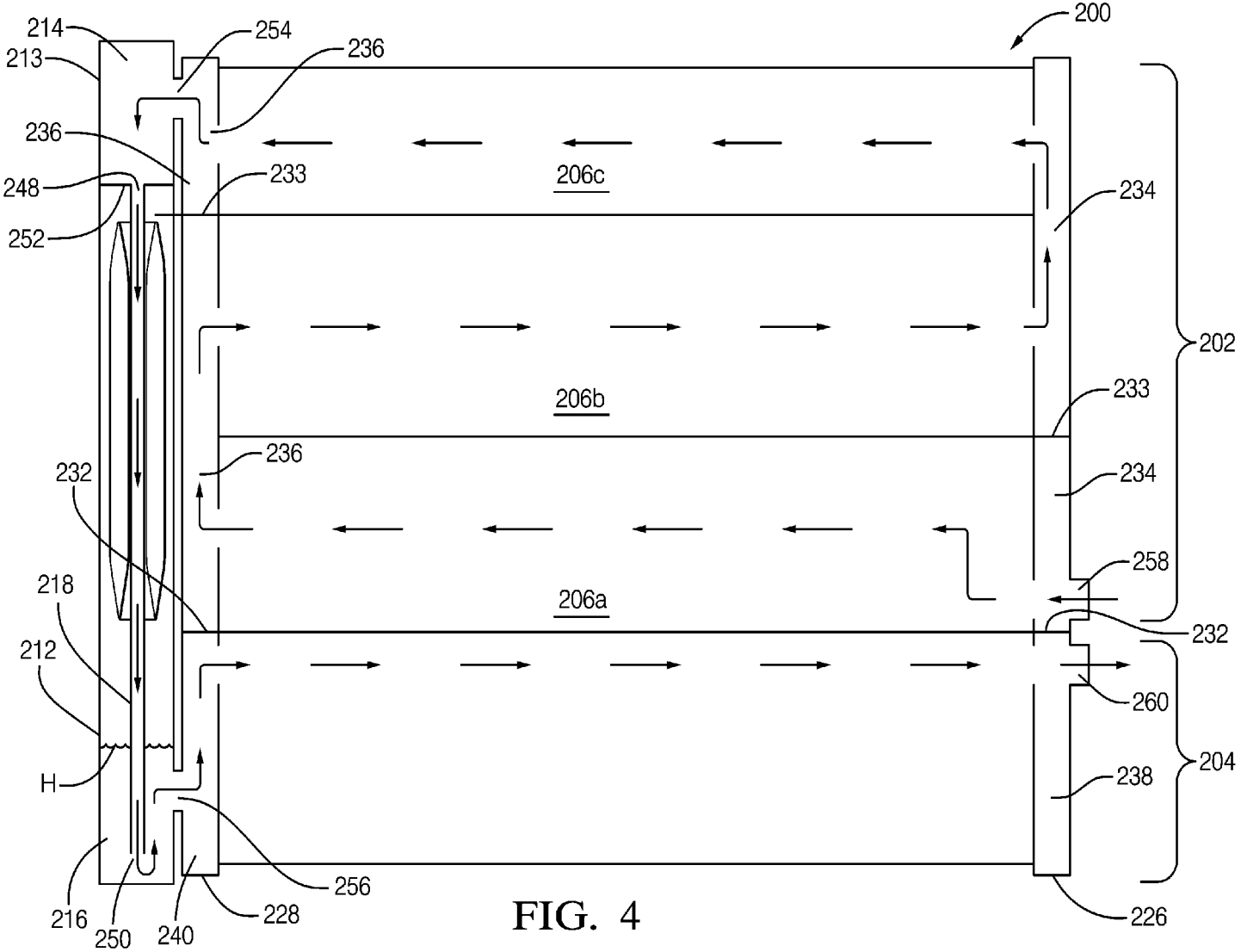
FIG. 4 shows a schematic front view of the sub-cooled condenser of FIG. 3.
Figure 5:
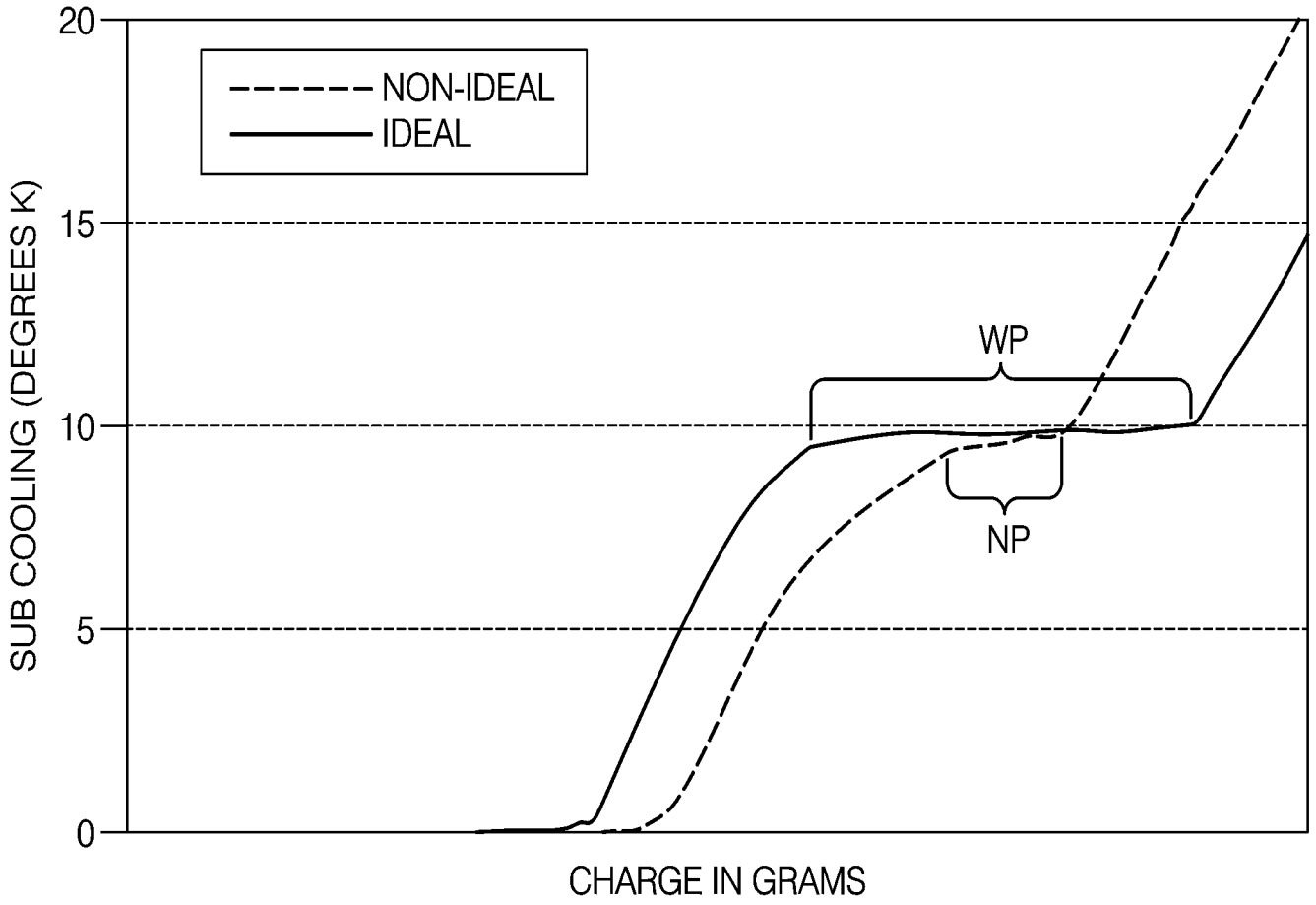
FIG. 5 is a graph of the degree of sub-cooling versus the amount of charge of refrigerant in an air conditioning system.
Figure 6:
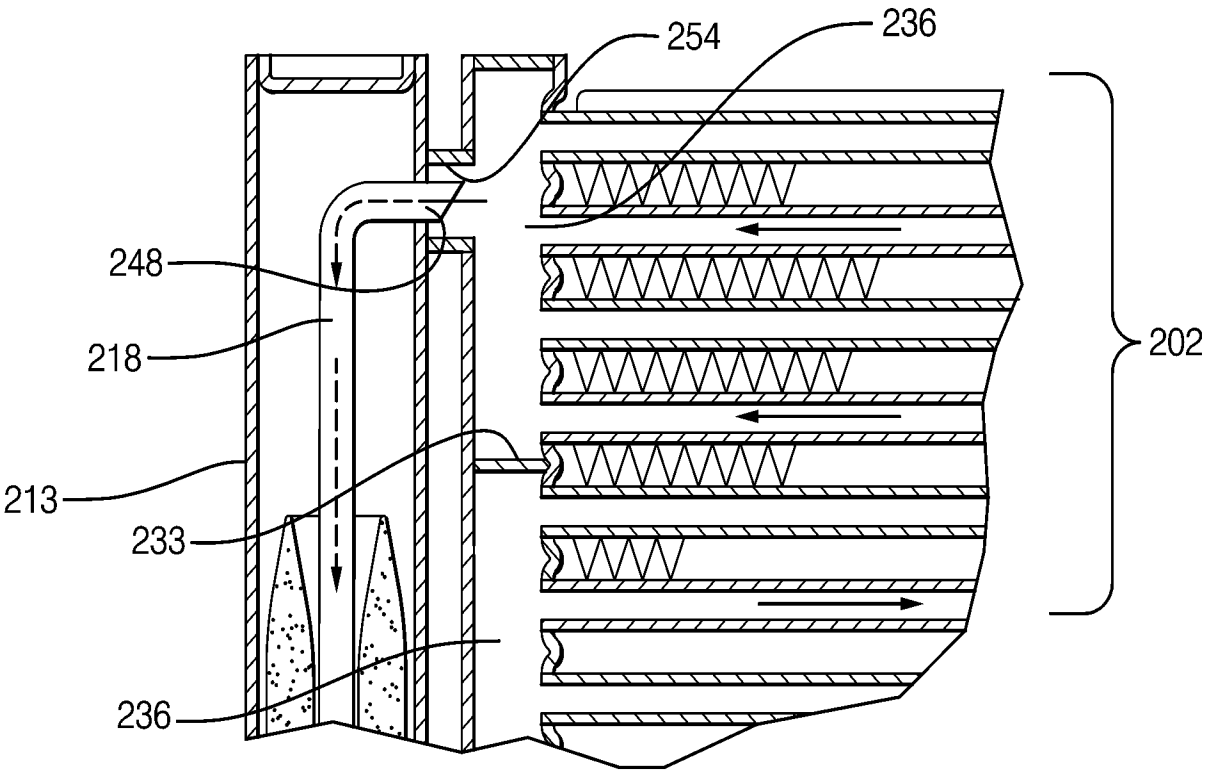
FIG. 6 is a partial cross-sectional view of an alternative embodiment of the sub-cooled condenser of FIG. 3.

Referring now to the FIGS. 1 through 6, wherein like numerals indicates like or corresponding parts throughout the several views, is a prior art a sub-cooled condenser 10 having an integral receiver tank 16 (FIG. 1), a prior art multi-pass sub-cooled condenser 100 having an external receiver tank 116 (FIG. 2), an embodiment of a sub-cooled condenser 200 having a top entrance integral receiver tank 212 of the present invention (FIGS. 3 and 4), a graph of the degree of sub-cooling versus the amount of charge of refrigerant in an air conditioning system (FIG. 5), and an alternative embodiment of the sub-cooled condenser 200 (FIG. 6).

Figure 1:
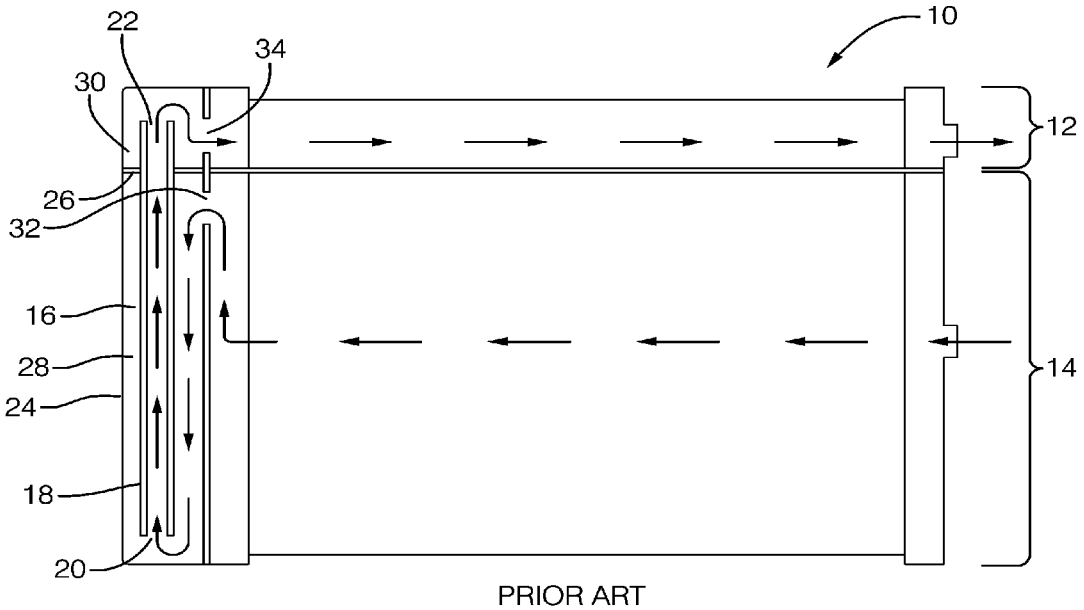
PRIOR ART FIG. 1
FIG. 1 shows a schematic front view of a prior art sub-cooled condenser having an integral receiver tank.

Shown in FIG. 1 is a schematic front view of a sub-cooled condenser 10 disclosed in U.S. Pat. No. 7,213,412 to Kent et al. (Kent '412). The sub-cooled condenser 10 includes an upper sub-cooler portion 12, a lower condenser portion 14, and an integral receiver tank 16. The integral receiver tank 16 includes a refrigerant conduit 18 that extends between a lower entry end 20 and an upper discharge end 22 within a receiver housing 24. The refrigerant conduit 18 is engaged to a receiver separator 26 that divides the receiver housing 24 into a receiver first chamber 28 and a receiver second chamber 30, in which the entry end 20 and discharge end 22 of the refrigerant conduit 18 extend into the receiver first chamber 28 and receiver second chamber 30, respectively. A first fluid port 32 is provided between the lower condenser portion 14 and the receiver first chamber 28, and a second fluid port 34 is provided between the upper sub-cooler portion 12 and the receiver second chamber 30. A condensed refrigerant flows into the receiver first chamber 28 from the lower condenser portion 14 through the first fluid port 32, continues up through the refrigerant conduit 18 to the receiver second chamber 30, and then exits the second fluid port 34 into the upper sub-cooler portion 12. The integral receiver tank 16 of Kent '412 with the up-flow refrigerant conduit 18 provides for a sub-cooled condenser 10 that is compact and readily plumbed into an air conditioning system of a motor vehicle.

Figure 2:
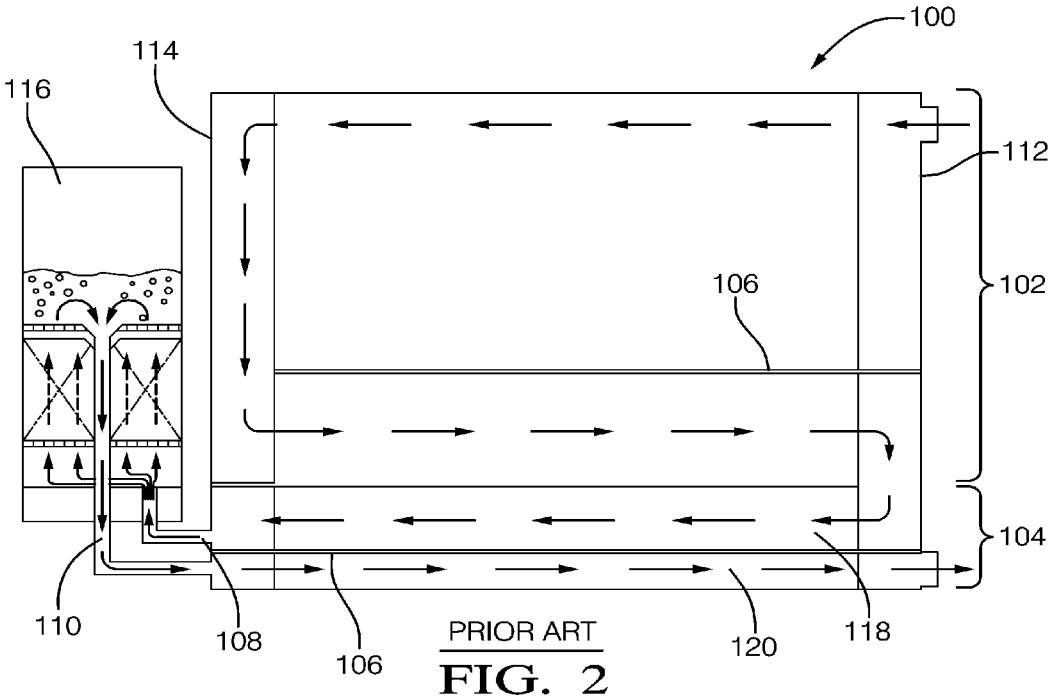
PRIOR ART FIG. 2
FIG. 2 shows a schematic front view of a prior art multi-pass sub-cooled condenser having a separate receiver tank.

Shown in FIG. 2 is a schematic front view of a sub-cooled condenser 100 disclosed in U.S. Pat. No. 6,494,059 to Yamazaki et al. (Yamazaki '059). The sub-cooled condenser 100 includes a multi-pass upper condenser portion 102 and a multi-pass lower sub-cooler portion 104. Internal partitions 106 are utilized at predetermined locations within the inlet/outlet header 112 and the return header 114 to subdivide an upstream group of tubes to define the multi-pass condenser portion 102 and a downstream group of tubes to define the multi-pass sub-cooler portion 104. Yamazaki '059 discloses an external receiver tank 116 for receiving the liquefied refrigerant exiting from the first pass 118 of the multi-pass sub-cooler portion 104. The external receiver tank 116 includes a bottom refrigerant inlet and outlet 108, 110, and internal features to provide a stable liquefied refrigerant to the remaining passes 120 of the multi-pass sub-cooler portion 104. The down-flow multi-pass condenser portion 102 of Yamazaki '059 increases the heat transfer efficiency to condense the vapor refrigerant into a liquid refrigerant, while the external receiver tank 116 provides a stable liquefied refrigerant to the remaining passes 120 of the sub-cooler portion 104 for improved performance of the air-conditioning system.

The sub-cooled condenser 100 and external receiver tank 116 of Yamazaki '059 is complex with respect to the space and plumbing requirements for installation in a motor vehicle as compared to the compact sub-cooled condenser of Kent '412. An embodiment of a sub-cooled condenser 200 of the present invention ensures a stable liquefied refrigerant to the sub-cooler portion of the condenser and provides for a compact package that is simple to plumb within a motor vehicle. The sub-cooled condenser 200 includes features that provide the further advantage of absorbing the fluctuations in the required refrigerant amount inside the refrigerant cycle caused through changes in load demands, while maintaining constant performance and quality against leakage of refrigerant from hoses and fittings.

Figure 3:
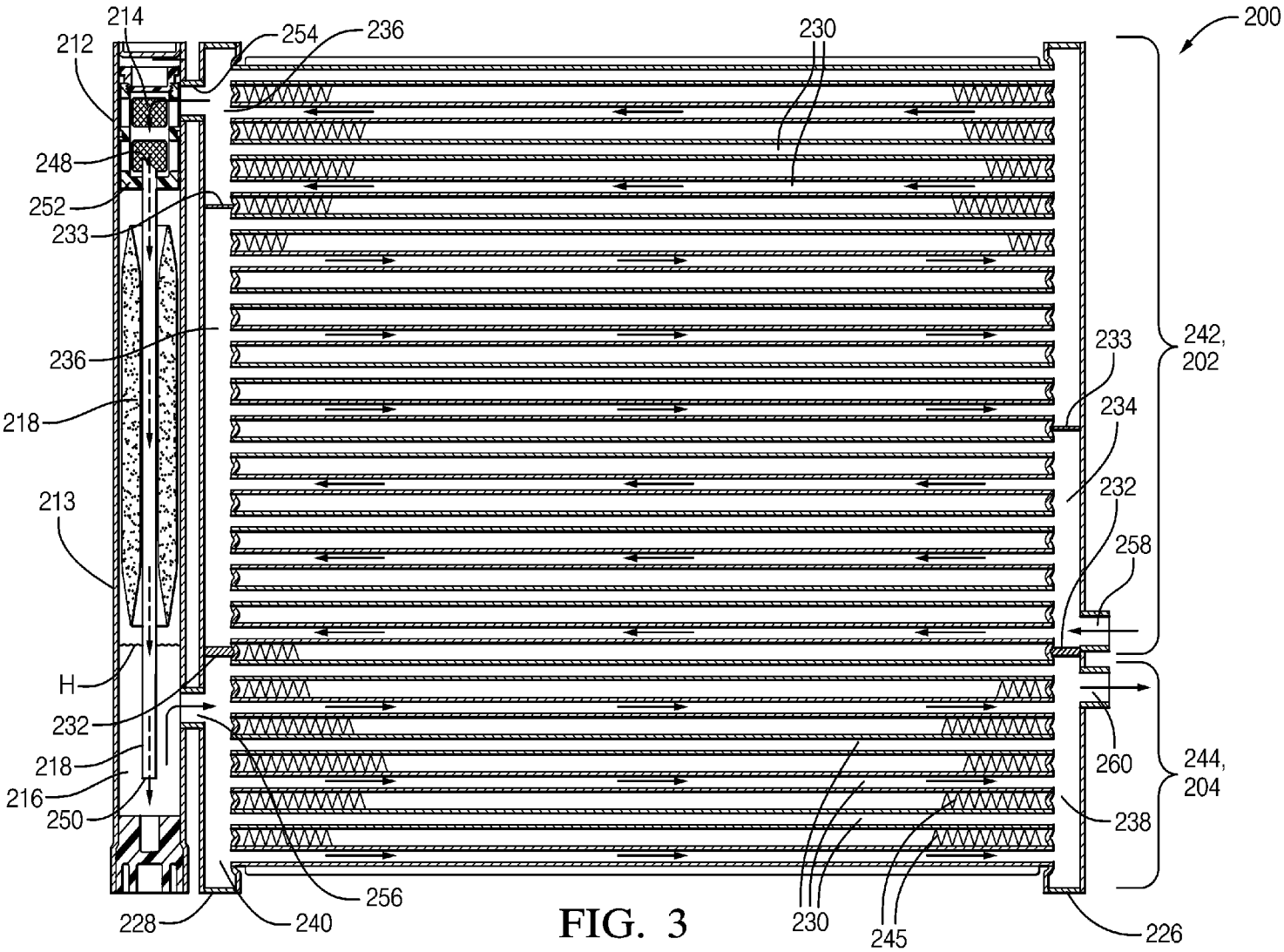
FIG. 3 shows a front cross-sectional view of an embodiment of a sub-cooled condenser of the present invention having a top entrance integral receiver tank.

Shown in FIG. 3 is an embodiment of the sub-cooled condenser 200 of the present invention and shown in FIG. 4 is a schematic front view of the sub-cooled condenser 200 of FIG. 3. The sub-cooled condenser 200 includes an upper condenser portion 202 configured for up-ward flow of refrigerant, a single-pass lower sub-cooler portion 204, and an integrated receiver tank 212 having a top entrance of a condensed refrigerant. The upper condenser portion 202 cooperates with the top entrance receiver tank 212 to provide a stable liquefied refrigerant to the sub-cooler portion 204, thereby improving the sub-cooling of the liquefied refrigerant. The improved sub-cooling of the liquefied refrigerant prior to an expansion valve (not shown) increases the cooling performance of the air conditioning system.

The sub-cooled condenser 200 includes an inlet/outlet header 226, a return header 228 spaced from the inlet/outlet header 226, a plurality of tubes 230 extending between and in hydraulic communication with the inlet/outlet header 226 and return header 228. Both the inlet/outlet header 226 and return header 228 include a header partition 232 that divides each of the headers 226, 228 into corresponding first chambers 234, 236 and second chambers 238, 240. The plurality of tubes 230 includes a first group of tubes 242 and a second group of tubes 244, in which the first group of tubes 242 is in hydraulic communication with the inlet/out header first chamber 234 and the return tank first chamber 236, and the second group of tubes is in hydraulic communication with the inlet/out header second chamber 238 and the return tank second chamber 240. The first group of tubes 242 together with the corresponding first chambers 234, 236 defines a condenser portion 202. Similarly, the second group of tubes 244 together with the corresponding second chambers 238, 240 defines a sub-cooler portion 204. With respect to the direction of gravity, the condenser portion 202 is located above that of the sub-cooler portion 204.

A chamber partition 233 is inserted in a predetermined location within the inlet/out header first chamber 234 and within return header first chamber 236. The chamber partition 233 within the return header first chamber 236 is above that of the chamber partition 233 within the inlet/outlet header first chamber 234. The chamber partitions 233 cooperates with the inlet/outlet header 226, return header 228, and the first group of tubes therebetween the headers 226, 228 to define multiple refrigerant passes 206*a*, 206*b*, 206*c* in the condenser portion 202, hence a multi-pass condenser portion 206, as shown in FIG. 4. The multi-pass condenser portion 202 includes a first-pass 206*a*, a second-pass 206*b* above the first-pass 206*a*, and a third-pass or last-pass 206*c* above the second-pass 206*b* with respect to the direction of gravity. While a multi-pass condenser portion 202 having three passes 206*a*, 206*b*, 206*c* is shown, it should be noted that the invention is not meant to be limited to such and may include additional passes as provided by the placement of additional chamber partitions 233 within the respective first chambers 234, 236. The condenser portion 202 may also be that of a single-pass (not shown). A plurality of corrugated fins 245 is interposed between the tubes 230 to increase heat transfer efficiency. The condenser portion 202 and sub-cooler portion 204, together with the corrugated fins 245, define the condenser core 246.

Adjacently parallel to and integral with the return header 228 is an elongated receiver tank 212. The receiver tank 212 includes a receiver housing 213 containing a refrigerant conduit 218 that extends between a top entry end 248 and a bottom discharge end 250 within the receiver housing 213. The receiver housing 213 or refrigerant conduit 218 may include a receiver separator 252 that divides the receiver housing 213 into a receiver first chamber 214 and a receiver second chamber 216. The refrigerant conduit entry end 248 and refrigerant conduit discharge end 250 extend into the receiver first chamber 214 and receiver second chamber 216, respectively. A first fluid port 254 is provided between the return header first chamber 236 adjacent to the third-pass 206*c* and the receiver first chamber 214 for refrigerant flow from the third-pass 206*c* to the receiver tank 212. A second fluid port 256 is provided between the return header second chamber 240 adjacent to the sub-cooler portion 204 and the receiver second chamber 216 for refrigerant flow from the receiver tank 212 to the sub-cooler portion 204. The second fluid port 256 may be positioned above the refrigerant conduit discharge end 250, the advantage of which is disclosed below.

Shown in FIG. 6 is an alternative embodiment of the sub-cooled condenser 200 of the present invention. The refrigerant conduit entry end 248 may be coupled to the first fluid port 254 such that the refrigerant conduit 218 is in direct hydraulic communication with the condenser portion 202, thereby eliminating the need of dividing the receiver housing 213 into a receiver first chamber 214 and a receiver second chamber 216.

The inlet/outlet header 226 includes an inlet opening 258 in hydraulic communication with the inlet/outlet header first chamber 234 adjacent to the first-pass 206*a* and an outlet opening 260 in hydraulic communication with the inlet/outlet header second chamber 238 adjacent to the sub-cooler portion 204. The inlet opening 258 and outlet opening 260 may extend in the same direction and may be immediately adjacent to each other as shown in FIG. 3.

Referring to FIG. 4, a high pressure vapor refrigerant enters the inlet/out header first chamber 234 via the inlet opening 258 and flows through the first-pass 206*a* to the return tank first chamber 236. The refrigerant changes direction in the return tank first chamber 236 and flows upward through the second-pass 206*b* back to the inlet/outlet tank first chamber 234. Within the inlet/outlet header first chamber 234, the refrigerant changes direction once again and flows upward through the third pass 206*c* toward the return tank first chamber 236. As the refrigerant flows upward through the multi-passes 206*a*, 206*b*, 206*c* of the condenser portion 202, heat is released to the ambient air and the high pressure vapor refrigerant is condensed to a high pressure liquid refrigerant near its saturation temperature.

The high pressure condensed, or liquefied, refrigerant then flows from the return header first chamber 236 through the first fluid port 254 into the receiver first chamber 214. Once in the receiver first chamber 214, the condensed refrigerant flows down the refrigerant conduit 218 and into the receiver second chamber 216. Liquefied refrigerant accumulates in the receiver second chamber 216 and is drawn into the sub-cooler portion 204 based on the demand of the air conditioning system. During higher loads, a greater mass of refrigerant is required by the system as compared to that of lower loads. The receiver second chamber 216 is sized to provide sufficient volumetric capacity to absorb fluctuations in the required amount of refrigeration caused through changes in operating conditions inside the refrigeration cycle and to safe-guard against the amount of refrigerant loss due to leakage from hoses and fittings over the life of the air-conditioning system. A desiccant bag 219 may be inserted into the receiver second chamber 216 to remove any water residue in the refrigerant.

A sufficient amount of refrigerant is charged into the air conditioning system to ensure that the height of the surface H of the liquid refrigerant is above that of the second fluid port 256 even at the maximum load requirement of the air conditioning system. As disclosed above, the second fluid port 256 may be positioned above the refrigerant conduit discharge end 250, or in other words, the refrigerant conduit discharge end 250 extends below the second fluid port 256. The submerged discharge end 250 of the refrigerant conduit 218 enables the liquefied refrigerant to enter the receiver second chamber 216 below the surface H of the liquefied refrigerant. Without the refrigerant conduit 218 having the discharge end 250 below surface H of the liquid refrigerant and adjacent to or below the second fluid port 256, the liquefied refrigerant entering the top of the receiver second chamber 216 would splash impact the surface H of the liquefied refrigerant, thereby causing turbulent mixing of the gas and liquid phases within the receiver housing 213, and this would disrupt the supply of liquefied refrigerant to the sub-cooler portion 204.

Shown in FIG. 5 is a graph showing the correlation between the sub-cooled temperature (degrees K) of the refrigerant exiting the sub-cooler portion 204 and the amount of refrigerant charge (grams) in a typical air conditioning system. The graph is generated by increasing the refrigerant charge in an air-conditioning system by a known amount and then plotting the results of the individual points together so the stability region, shown as a plateau, can be seen and the ideal charge can be determined.

Represented by the solid line curve is an embodiment of the sub-cooled condenser 200 operating at steady state at a predetermined sub-cooling temperature (° K) through a wide range of refrigerant charge (grams). The solid line curve is shown as a rising curve that is steep until it reaches a flat and wide plateau (WP), before rising again as additional refrigerant is added to the system. A wide plateau (WP) is an indication that the sub-cooled condenser 200 operates at an efficient steady state over a wide range of refrigerant charge. It is desirable for a sub-cooled condenser to have a plateau that is flat and wide to take into the variation of refrigerant charge due to system demands and losses due to leaks, as well as variations in the initial system charge. Represented in the broken line curve is a prior art sub-cooled condenser operating at a steady state at a predetermined sub-cooling temperature over a range of refrigerant charges. The narrow plateau (NP) of the broken line cure indicates that the prior art sub-cooled condenser operates at an efficient steady state only in a narrow band of the refrigerant charge. In other words, the refrigerant charge has to be maintained within a narrow range in order for the prior art sub-cooled condenser to operate efficiently, whereas the embodiment of the sub-cooled condenser 200 of the present invention operates efficiently over a wider range of refrigerant charge.

The sub-cooled condenser 200, including its headers 226, 228, refrigerant tubes 242, 244, receiver housing 213, and refrigerant conduit 218 may be manufactured from any materials or methods known by those of ordinary skill in the art. As a non-limiting example, the sub-cooled condenser 200 may be manufactured from an aluminum alloy, assembled, and brazed.

While this invention has been described in terms of the preferred embodiments thereof, it is not intended to be so limited, but rather only to the extent set forth in the claims that follow.

Having described the invention, it is claimed:

1. A sub-cooled condenser for use in an air conditioning system, comprising:

a first header having two header partitions dividing the first header into a lower first header chamber, an upper first header chamber above the lower first header chamber, and a second chamber below the lower first header chamber with respect to the direction of gravity;

a second header having two header partitions dividing the second header into a lower first header chamber, an upper first header chamber above the lower first header chamber, and a second chamber below the lower first header chamber with respect to the direction of gravity;

three upstream groups of refrigerant tubes extending between and all of which are in hydraulic connection with the first header and said second header, a first one of the three upstream groups hydraulically connecting the lower first header chamber of the first header with the lower first header chamber of the second header, a second one of the three upstream groups hydraulically connecting the lower first header chamber of the second header with the upper first header chamber of the first header, and a third one of the three upstream groups hydraulically connecting the upper first header chamber of the first header with the upper first header chamber of the second header, thereby defining a condenser portion that condenses the refrigerant flowing therethrough to a liquid;

an inlet opening of the sub-cooled condenser in fluid communication with the lower first header chamber of the first header;

an outlet opening of the sub-cooled condenser in fluid communication with the second header chamber of the first header, the outlet opening located below the inlet opening with respect to the direction of gravity;

a downstream group of refrigerant tubes extending between and in hydraulic connection with the second chamber of the first header and the second chamber of the second header, thereby defining a sub-cooler portion;

the condenser portion is located above the sub-cooler portion with respect to the direction of gravity;

an elongated receiver housing extending adjacently parallel to the second header, wherein the receiver housing includes a first fluid port in hydraulic connection with the upper first header chamber of the second header for receiving a liquid refrigerant from the upper first header chamber of the second header, and a second fluid port in hydraulic connection with the sub-cooler portion for discharging a liquid refrigerant to the sub-cooler portion; and a continuous refrigerant conduit disposed in the receiver housing, wherein the refrigerant conduit includes a top entry end and a bottom discharge end spaced from the top entry end, wherein the top entry end is in hydraulic communication with the first fluid port and the bottom discharge end is in hydraulic communication with the second fluid port, wherein the bottom discharge end extends below that of the second fluid port.

2. The sub-cooled condenser for use in an air conditioning system of claim 1, wherein the top entry end of refrigerant conduit is hydraulically coupled to the first fluid port such that the liquid refrigerant flows from the condenser portion through the first fluid port directly into the refrigerant conduit.

3. The sub-cooled condenser for use in an air conditioning system of claim 1, wherein the receiver housing includes a receiver separator dividing the receiver housing into a receiver first chamber having the first fluid port and a receiver second chamber having the second fluid port, and wherein the top entry end of refrigerant conduit extends into the receiver first chamber and the bottom discharge end of refrigerant conduit extends in the receiver second chamber.

4. The sub-cooled condenser for use in an air conditioning system of claim 3, wherein the bottom discharge end extends below that of the second fluid port.

5. The sub-cooled condenser for use in an air conditioning system of claim 4, wherein each of the first chamber of the first header and the first chamber of the second header includes at least one chamber partition dividing the condenser portion into multiple passes including a first-pass and a last-pass, wherein the first pass is below that of the last pass; and wherein the first chamber of the first header includes an inlet opening adjacent to and in hydraulic communication with the first-pass of the condenser portion; and wherein the first fluid port of the receiver first chamber is adjacent to and in hydraulic communication with the last-pass of the condenser portion.

6. The sub-cooled condenser for use in an air conditioning system of claim 5, wherein the second chamber of the first header includes an outlet opening adjacent to and in hydraulic communication with the sub-cooler portion.

7. The sub-cooled condenser for use in an air conditioning system of claim 6, wherein the first fluid port hydraulically connects the first chamber of the second header with the receiver first chamber for directing a condensed refrigerant from the condenser portion to the receiver tank.

8. The sub-cooled condenser for use in an air conditioning system of claim 7, wherein the second fluid port hydraulically connects the receiver second chamber with the second chamber of the second header for directing the condensed refrigerant from the receiver tank to the sub-cooler portion.

9. The sub-cooled condenser for use in an air conditioning system of claim 8, wherein the receiver second chamber is sized to contain sufficient refrigerant capacity to absorb fluctuations in the required amount of refrigeration caused through changes in operating conditions inside the refrigeration cycle and to safe-guard against the amount of refrigerant loss due to leakage over the life of the air-conditioning system, while maintaining a surface level of liquid refrigerant above that of the second fluid port.

* * * * *